US011111810B2

(12) United States Patent
Bazot

(10) Patent No.: US 11,111,810 B2
(45) Date of Patent: Sep. 7, 2021

(54) CONTROL ASSEMBLY FOR A STAGE OF VARIABLE-PITCH VANES FOR A TURBINE ENGINE

(71) Applicant: SAFRAN AIRCRAFT ENGINES, Paris (FR)

(72) Inventor: Olivier Bazot, Moissy-Cramayel (FR)

(73) Assignee: SAFRAN AIRCRAFT ENGINES, Paris (FR)

( * ) Notice: Subject to any disclaimer, the term of this patent is extended or adjusted under 35 U.S.C. 154(b) by 85 days.

(21) Appl. No.: 16/271,283

(22) Filed: Feb. 8, 2019

(65) Prior Publication Data

US 2019/0249561 A1 Aug. 15, 2019

(30) Foreign Application Priority Data

Feb. 9, 2018 (FR) ..... 1851097

(51) Int. Cl.
*F01D 17/16* (2006.01)
*F04D 29/56* (2006.01)

(52) U.S. Cl.
CPC ..... *F01D 17/162* (2013.01); *F04D 29/563* (2013.01); *F05D 2230/642* (2013.01);
(Continued)

(58) Field of Classification Search
CPC . F01D 25/28; F01D 7/162; F01D 7/16; F01D 7/12; F01D 7/14; F04D 29/563;
(Continued)

(56) References Cited

U.S. PATENT DOCUMENTS 3,303,992 A * 2/1967 Johnson ..... F01D 17/162 415/149.4
4,925,364 A * 5/1990 Das ..... F01D 17/162 415/150

(Continued)

FOREIGN PATENT DOCUMENTS

EP 0 375 593 A1 6/1990
EP 2 107 217 A1 10/2009

(Continued)

OTHER PUBLICATIONS

French Search Report dated Oct. 19, 2018, issued in French Application No. 1851097, filed Feb. 9, 2018, 2 pages.

*Primary Examiner* — Igor Kershteyn
*Assistant Examiner* — Joshua R Beebe
(74) *Attorney, Agent, or Firm* — Christensen O'Connor Johnson Kindness PLLC

(57) ABSTRACT

A control assembly for a stage of variable-pitch vanes for a turbine engine generally includes an actuating ring having an annular body, a vane guidance means for connecting to the cylindrical pivots of the variable pitch vanes, a rotating means for rotating the actuating ring about a casing of the turbine engine, and a centering means for cooperating with the casing to center the actuating ring. The centering means may have at least one skid bearing against the casing. At least one of the skid or the rod may be configured to cooperate by radial sliding with an inner wall of a housing. The skid may be configured to be mobile during operation by sliding between a radially internal position and a radially external position.

9 Claims, 3 Drawing Sheets

(52) U.S. Cl.
CPC ..... *F05D 2240/12* (2013.01); *F05D 2240/50* (2013.01); *F05D 2260/38* (2013.01)

(58) Field of Classification Search
CPC .. F04D 29/56; F04D 27/002; F05D 2230/642; F05D 2240/12; F05D 2240/50; F05D 2260/38
See application file for complete search history.

(56) References Cited

U.S. PATENT DOCUMENTS

| | | | | | |
|---|---|---|---|---|---|
| 6,092,984 | A * | 7/2000 | Bouyer | F16F 15/04 | 415/119 |
| 6,339,516 | B1 * | 1/2002 | Martin | G11B 17/038 | 29/603.03 |
| 10,184,350 | B2 * | 1/2019 | Hall | F01D 17/162 | |
| 2006/0193720 | A1 * | 8/2006 | Bromann | F01D 17/162 | 415/160 |
| 2007/0183889 | A1 * | 8/2007 | Bromann | F04D 29/563 | 415/160 |
| 2016/0201504 | A1 * | 7/2016 | Hall | F01D 25/246 | 415/148 |
| 2016/0281533 | A1 * | 9/2016 | Peer | F01D 25/28 | |
| 2018/0266267 | A1 * | 9/2018 | Edynak | F01D 17/14 | |
| 2018/0320552 | A1 * | 11/2018 | Harris | F01D 25/16 | |

FOREIGN PATENT DOCUMENTS

| | | | | |
|---|---|---|---|---|
| FR | 2 882 578 | A1 | 9/2006 | |
| WO | WO-2016092172 | A1 * | 6/2016 | F01D 17/16 |

* cited by examiner

CONTROL ASSEMBLY FOR A STAGE OF VARIABLE-PITCH VANES FOR A TURBINE ENGINE

CROSS-REFERENCE TO RELATED APPLICATION

This application claims priority under 35 U.S.C. § 119 to French Patent Application No. 1851097, filed Feb. 9, 2018, which is herein incorporated by reference in its entirety.

BACKGROUND

The present disclosure generally relates to a control assembly for a stage of variable-pitch vanes for a turbine engine. In an embodiment, this type of stage comprises an annular row of variable-pitch stator vanes (also called VSV, for Variable Stator Vanes) which are supported by an outer annular casing, in general of a turbine engine compressor. Each vane comprises a blade connected by the radially external end thereof by a substantially circular plate to a radial cylindrical pivot that defines the axis of rotation of the vane and that is rotationally guided in a corresponding orifice of the outer casing. The radially internal end of the blade of each vane generally comprises a second cylindrical pivot extending along the axis of rotation of the vane and rotationally guided in an orifice of an inner casing of the compressor.

In the present application, the terms "radial", "radially", "axial", etc. refer to the longitudinal axis or the axis of revolution of the ring or of the annular body thereof.

The radially external end of the external pivot of each vane is connected by a tie rod to an actuating ring rotationally moved around the outer casing by actuating means comprising an actuator or a similar component. The rotation of the actuating ring is transmitted by tie rods to the external pivots of the vanes, which causes them to rotate about the axes thereof.

The angular pitch of the stator vanes in a turbine engine is intended to adapt the geometry of the compressor to the operating point thereof, and in particular to optimize the yield and the compressor stall margin of the turbine engine, and to reduce the fuel consumption thereof during different flight phases.

Each of these vanes is rotationally movable about the axis thereof between a first "opening" or "full opening" position, wherein each vane extends substantially parallel to a longitudinal axis of the turbine engine, and a second "closed" or "nearly closed" position, wherein the vanes are at an angle with respect to the axis of the turbine engine and thereby reduce the section of the airflow through the stage of vanes.

The actuating ring is centered and rotationally guided about the axis of rotation thereof.

In the current art, the ring is equipped with skids protruding radially inwards, on which the outer periphery of the casing can cooperate by friction.

The skids, on the one hand, ensure the concentricity of the ring around the casing by adjustment of the skids/casing clearance, and on the other hand, limit the deformation of the ring generated by aerodynamic stresses on the vanes exerted on the kinematics during operations.

In the current art, a guiding skid is inserted in a housing of the body of the ring and comprises a tapped orifice for the insertion of a screw that receives a nut bearing against the outer periphery of the body of the ring. The screw is used to adjust the accurate radial position of the skid with respect to the body, and is also called "adjustment screw", and the nut is used to immobilize the screw in this position. This screw comprises two threads: a first thread with a standard pitch that receives the nut, and a thread with a thin pitch that is screwed into the tapped orifice of the skid and makes it possible for the fine adjustment of the above-mentioned position and of the radial clearance between the skid and the casing.

The screwed connection between the screw and the skid is not blocked and there is a clearance between the skid and the adjustment screw. During operations, the presence of this clearance causes, under the effect of surrounding vibrations, a relative movement between the parts, which leads to the destruction of the threaded connection. Therefore, the function of the skid is no longer ensured.

In addition, this wear directly impacts the pitch angle of the variable-pitch vanes during operations, which can impact the proper operability of the engine (compressor stall in the case of a significant amount of skids used on one single stage).

The present disclosure proposes to improve this technology.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In aspect, the present disclosure generally relates to a control assembly for a stage of variable-pitch vanes for a turbine engine. In an embodiment, the disclosure proposes a control assembly for a stage of variable-pitch vanes for a turbine engine, comprising an actuating ring having an annular body having an axis of revolution, first means configured to be connected to the pivots of said vanes, second means configured to be connected to actuating means for the rotation of the actuating ring about a casing of the turbine engine, and third means configured to cooperate with the casing to center and guide the actuating ring, said third means comprising at least one skid bearing against said casing, the skid being secured to a rod that intersects with a substantially radial housing of the actuating ring, and the skid comprising an abutment element bearing against a radially external surface of the actuating ring, the skid and/or said rod being configured to cooperate by radial sliding with at least one inner wall of said housing, with the elastically deformable means being mounted between the skid and the actuating ring to force the skid radially towards the casing, said skid being configured to be, during operations, mobile by sliding between a first radially internal position defined by bearing against the abutment element on the actuating ring, and a second radially external position wherein the abutment element is at a distance from the actuating ring.

In an embodiment, the skid and the screw are first secured to one another, i.e. they are connected by a rigid connection and not a screwed connection, as was the case in the prior art. This prevents the existence and the appearance of clearances between these parts. Moreover, the skid and/or the screw facilitate the radial sliding thereof in the housing of the body of the ring during operations. In an embodiment, the disclosure proposes leaving the skid radially free, so that it adopts a position adapted to that of the casing, i.e. depending on the movement and deformation of the casing during operations. The skid is forced radially outwards by elastically deformable means and bears against the casing. If the casing undergoes deformations, the skid thereof can follow these deformations and be moved inwards or outwards. The radially internal end position thereof is defined by the nut bearing against the body of the ring. In an embodiment, this nut is not used to immobilize the screw radially. This solution makes it possible for the skids supported by the ring to follow the deformations and movements of the casing, independently from one another. It further enables a self-centering of the ring during operations because of the biasing of the skids against the casing by the elastically deformable means. In an embodiment, the skids are constantly bearing against the casing, which eliminates all clearances in this zone. Indeed, the skid is free to slide inside the housing of the ring and the elastically deformable means generate a force ensuring a contact between the skid and the casing. The advantage of this solution is to improve the concentricity of the ring with respect to the casing, throughout a flight mission, using the force exerted by the elastically deformable means, guaranteeing improved accuracy of the kinematics of the variable-pitch vanes. The clearance enabling absorbing the differential expansion between the casing and the assembly comprising the actuating ring and the guiding skids is itself transferred inside the housing of the ring and makes it possible to limit the movement of the skid, for example by means of a special abutment. In addition, the implementation of this solution makes it possible to eliminate the wear of the skids currently reported in fleets, thereby guaranteeing the proper operability of the engine. Finally, the procedure for adjusting the clearance under the skids is here eliminated as it is no longer necessary to adjust the clearances by the screwing and unscrewing of the skid.

Embodiments of the assembly according to the disclosure can comprise one or more of the following characteristics, taken individually or in combination:

the skid and the rod are monolithic, the rod comprises a cylindrical section and a threaded section, the cylindrical section being configured to cooperate by sliding with an internal cylindrical surface of the housing, and the abutment element being a nut that cooperates with the threaded section of the rod, said elastically deformable means are annular and extend around said skid, said skid comprises a first cylindrical portion with a diameter that is smaller than a second cylindrical portion, said first portion extending between said rod and the second portion, the second portion being configured to bear against the casing, said first portion is configured to cooperate by sliding with an internal cylindrical surface of said housing, said internal cylindrical surface of the housing is connected at the radially external end thereof to an annular shoulder against which said portion can abut radially, said internal cylindrical surface is connected at the radially internal end thereof to a second annular shoulder against which the elastically deformable means bear, the elastically deformable means comprise at least one coil spring and/or at least one disc spring of the Borrelly spring washer type for example, and the elastically deformable means bear against an internal peripheral surface of the ring.

In another aspect, the present disclosure also relates to a stage of variable-pitch vanes for a turbine engine, comprising an annular row of variable-pitch vanes, each comprising a blade and a cylindrical pivot at the radially external end thereof, the stage further comprising an annular casing comprising orifices for the mounting of the pivots of the vanes, the pivots being connected to a control assembly such as described above.

In another aspect, the present disclosure also relates to a turbine engine having at least one ring or at least one stage such as described above.

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

DESCRIPTION OF THE DRAWINGS

The foregoing aspects and many of the attendant advantages of this disclosure will become more readily appreciated as the same become better understood by reference to the following detailed description, when taken in conjunction with the accompanying drawings, wherein.

DETAILED DESCRIPTION

The detailed description set forth below in connection with the appended drawings, where like numerals reference like elements, is intended as a description of various embodiments of the disclosed subject matter and is not intended to represent the only embodiments. Each embodiment described in this disclosure is provided merely as an example or illustration and should not be construed as preferred or advantageous over other embodiments. The illustrative examples provided herein are not intended to be exhaustive or to limit the claimed subject matter to the precise forms disclosed.

In the following description, specific details are set forth to provide a thorough understanding of exemplary embodiments of the present disclosure. It will be apparent to one skilled in the art, however, that the embodiments disclosed herein may be practiced without embodying all of the specific details. In some instances, well-known process steps have not been described in detail in order not to unnecessarily obscure various aspects of the present disclosure. Further, it will be appreciated that embodiments of the present disclosure may employ any combination of features described herein.

The present application may also reference quantities and numbers. Unless specifically stated, such quantities and numbers are not to be considered restrictive, but exemplary of the possible quantities or numbers associated with the present application. Also in this regard, the present application may use the term "plurality" to reference a quantity or number.

Figure 1:
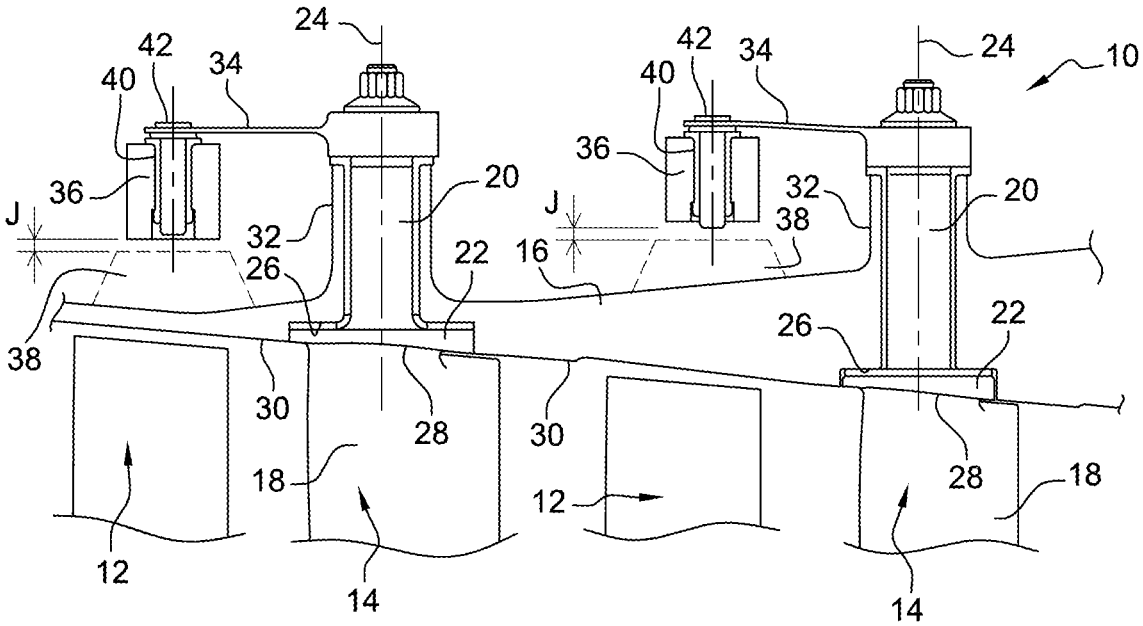
FIG. 1 shows a partial schematic half-view of an axial cross-section of a stage of variable-pitch vanes of a turbine engine.

FIG. 1 shows schematically, in an axial cross-section, a part of a high-pressure compressor 10 of a turbine engine, in particular the turbine engine of an aircraft, with several stages, each stage comprising an annular row of mobile vanes 12 supported by the rotor (not shown) of the turbine engine, and a row of fixed variable-pitch vanes 14 forming rectifiers supported by a casing 16 of the stator of the turbine engine, the angular orientation of the vanes 14 being adjustable to adapt the gaseous flow in the compressor 10 to the operating conditions of the turbine engine.

Each vane 14 comprises a blade 18 and a radially external cylindrical pivot 20, connected by a "plate" 22 extending about the axis 24 of the vane in a corresponding housing 26 of the casing 16. The radially internal surface 28 of the plate is flush with the inner wall 30 of the casing so as not to impede the gaseous flow.

The cylindrical pivot 20 of each blade 14 extends inside a radial cylindrical stack 32 of the casing 16 and the radially external end thereof is connected by vane guidance means comprising a tie rod 34 to a control assembly comprising an actuating ring 36 that surrounds the casing 16 and that is associated with actuating means (not shown) making it possible to rotate it in both directions about the longitudinal axis of the casing 16 to drive the vanes 14 of an annular row rotationally about the axes 24 thereof.

Each ring 36 comprises radial orifices 40, wherein are housed cylindrical pins 42 supported by the tie rods 34. Each pin 42 is generally centered and rotationally guided in the orifice 40 by at least one sleeve bearing mounted in the orifice 40.

The body of the ring 36 further comprises means to connect to an actuator, which can comprise, for example, a protection supporting an axis on which is hinged an end of a piston rod of an actuator, when the latter is a cylinder, for example.

The vanes 14 are rotationally movable about the axes 24 thereof between a closed or nearly closed position and an open or fully open position.

In the closed position, the blades 18 of the vanes are at an angle with respect to the longitudinal axis of the turbine engine and together define a minimum section for the airflow in the flow path. The vanes 14 are brought to this position when the turbine engine is operating at low speed or idling, the airflow through the compressor thus having a minimum value.

In the open position, the blades 18 of the vanes extend substantially parallel to the axis of the turbine engine so that the airflow section between the vanes is at the maximum thereof. The vanes 14 are brought to this position when the turbine engine is operating at full speed, the airflow through the compressor thus having a maximum value.

The casing 16 comprises, at the outer periphery thereof, protruding tracks 38 for the centering and guiding of the rings 36, which are here schematically shown by dotted lines. Each ring 36 surrounds the guiding track or tracks 38 thereof. The reference J means the radial cold clearances provided between the skids supported by the ring 36 and the tracks 38. These clearances J are sufficient to enable the thermal expansion of the casing 16, but they do not make it possible to accurately adjust the angular positions of the vanes 14.

The disclosure proposes improving this technology and aims at eliminating the radial clearances between the ring 36 and the casing 16.

Figure 2:
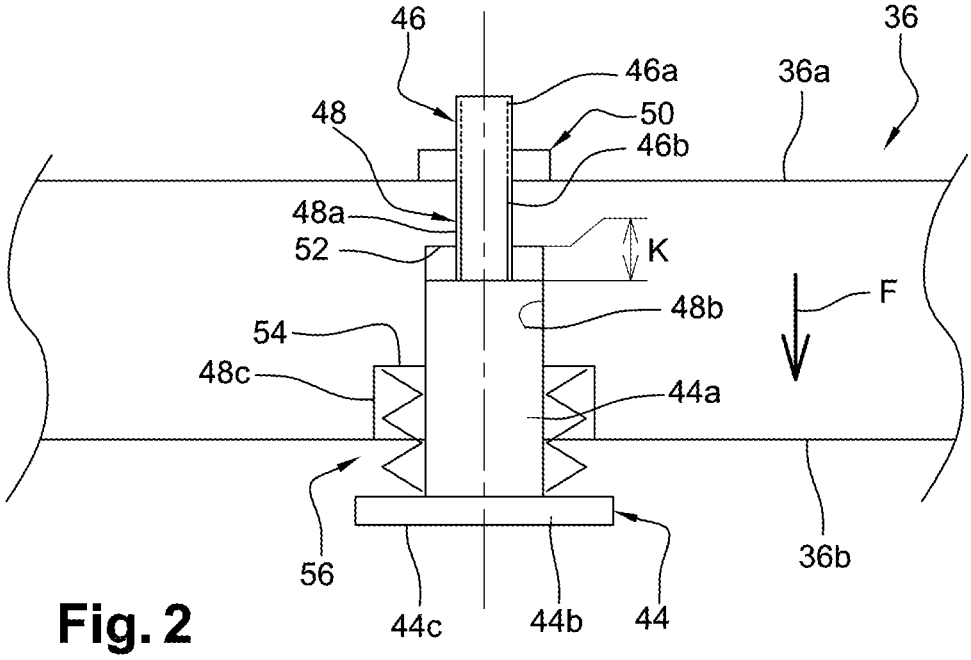
FIG. 2 shows a partial schematic half-view of an axial cross-section of a control assembly of a stage of variable-pitch vanes of a turbine engine according to the present disclosure.

FIG. 2 shows a non-limiting embodiment of the present disclosure wherein the same numbers are used to refer to the elements already described above with respect to FIG. 1.

The actuating ring 36 here comprises an annular body, that can be divided into sectors and is formed by at least two sectors arranged circumferentially end-to-end and secured to one another.

As described above, the body of the ring 36 can comprise radial orifices wherein are housed cylindrical pins supported by tie rods. The body of the ring 36 further comprises means to connect to actuating means such as an actuator, which can comprise, for example, a yoke bearing an axis on which is hinged an end of a piston rod of an actuator, when the latter is a cylinder, for example.

The ring 36 comprises at least one skid 44 bearing against the casing 16, which is secured to a screw 46. In practice, the ring can comprise several skids regularly distributed about the axis of revolution of the ring.

The skid 44 and the screw 46 are housed in a substantially radial housing 48 of the body of the ring. The screw 46 extends along a substantially radial axis between a radially external free end and a radially internal end connected to the skid 44. The screw 46 comprises two sections, respectively an inner section 46*b* and an outer section 46*a*. The inner section 46*b* comprises a smooth external cylindrical surface and is inserted by sliding in the cylindrical part 48*a* having the smallest diameter of the housing 48. The outer section 46*a* is threaded and receives a nut 50 that bears against an external peripheral surface 36*a* of the body of the ring.

The skid 44 has a general shape of an inverted T and comprises two cylindrical portions, respectively an inner portion 44*b* and an outer portion 44*a*. The inner cylindrical portion 44*b* has the greatest diameter and comprises a radially internal surface 44*c* bearing against the casing (the casing is not shown). The outer cylindrical portion 44*a* has the smallest diameter and is inserted by sliding in a cylindrical part 48*b* with an intermediate diameter of the housing 48. This cylindrical part 48*b* with an intermediate diameter extends between the cylindrical part 48*a* with the smallest diameter and a cylindrical part 48*c* with the greatest diameter that is located radially inside and opens onto an internal peripheral surface 36*b* of the body of the ring 36.

The housing 48 of the body of the ring 36 is therefore of a tiered type and comprises three stages or parts 48*a*, 48*b*, 48*c* connected to one another by annular shoulders 52, 54. A first annular shoulder 52 connects the parts 48*a*, 48*b* and a second annular shoulder 54 connects the parts 48*b*, 48*c*.

The outer diameter of the inner portion 44*b* of the skid 44 is greater than or equal to the inner diameter of the part 48*c* with the greatest diameter of the housing 48. Elastically deformable means 56 are mounted around the portion 44*a* of the skid, and axially bear against the portion 44*b* of the skid, on the side opposite the bearing surface 44*c* thereof, and against the shoulder 54.

The elastically deformable means 56 comprise, for example, at least one spring and/or at least one elastic washer.

Figure 3:
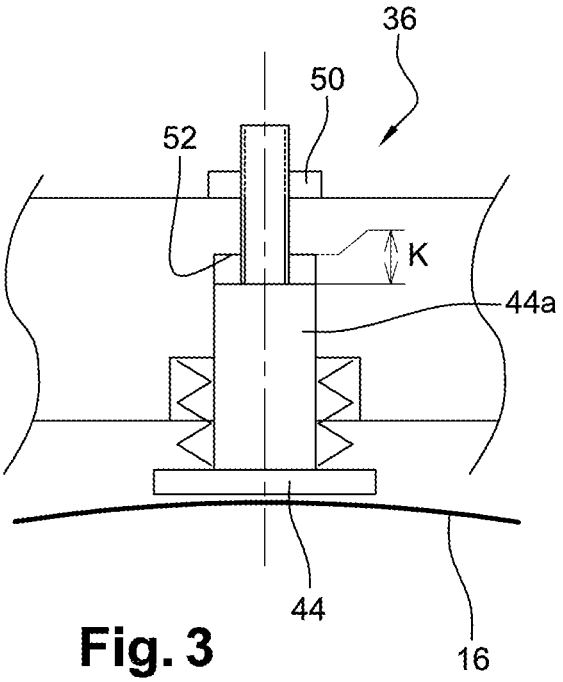
FIGS. 3 and 4 show half-views of two different radial positions of a skid of the control assembly of FIG. 2.

These means 56 force the skid 44 radially outwards and therefore exert a force in the direction shown by the arrow F. The skid 44 is therefore forced inwards until it is blocked radially in the direction F. This radial blocking is achieved by the nut 50 that bears against the surface 36*a*. The position of the nut 50 on the screw 46 is determined based on the cold or idling position of the casing 16 with respect to the ring, as shown in FIG. 3.

It is therefore be understood that because of the fact that the skid 44 bears against the casing 16, there is no clearance between the skid and the casing, and the abovementioned clearance J according to the prior art is replaced by a clearance K located here inside the ring 36, and specifically between the portion 44*a* and the shoulder 52.

Figure 4:
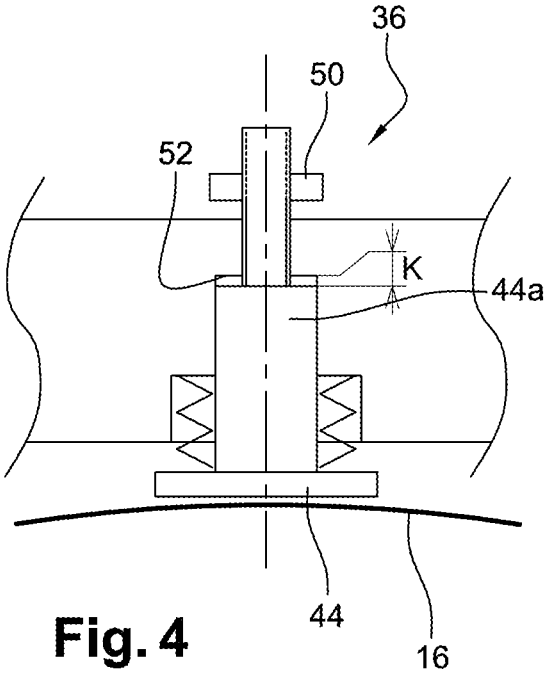

The clearance K is variable during operations because of the relative movements of the casing 16 and the ring 36. In the case of FIG. 4, the casing is radially moved outwards and has moved the skid 44 and the screw 46 inside the housing 48 of the body of the ring. The means 56 are then compressed and the clearance K is reduced. Moreover, the nut 50 screwed onto the screw 46 moves away from the body of the ring, with which it is no longer in contact.

Figure 5:
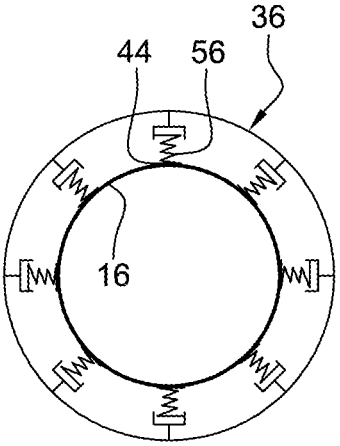
FIGS. 5 to 7 show schematic front views of a casing and of a control assembly according to the present disclosure at three different operating positions.
Figure 6:
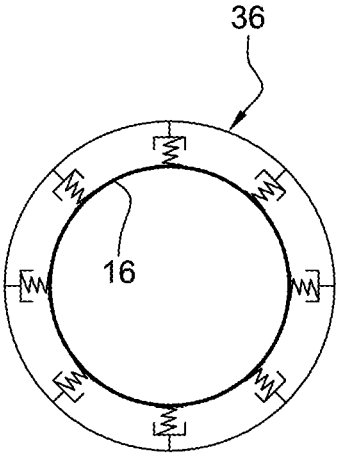
Figure 7:
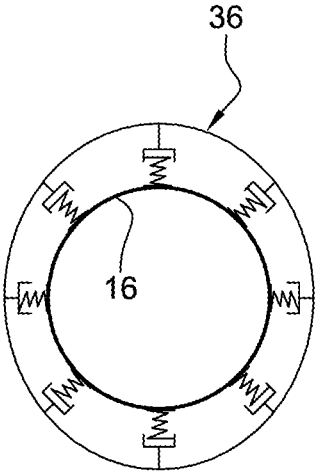

FIGS. 5 to 7 show different operating states of the turbine engine, respectively a cold operating state or an idling state (FIG. 5), a hot operating state with a constant deformation or expansion of the casing 16 about the axis of the turbine engine (FIG. 6), and a hot operating state with an irregular deformation or expansion of the casing around the axis of the turbine engine (FIG. 7).

When the turbine engine is in a cold state or idling (FIG. 5), the radial positions of the skids 44 are radially adjusted by screwing the nuts 50 to eliminate the radial clearances J between the skids 44 and the casing 16. During operations (FIG. 6), the casing 16 expands and the clearances K vary. These clearances can be different from one skid 44 to another based on the respective positions of the casing 16 and of the ring 36 in different location zones of the skids. The skids 44 can cooperate by abutment with the shoulders 52 of the body of the ring to limit the radial range of movement of the skids, and to limit the risk of ovalization of the ring, which reduces the accuracy of the circumferential movement of the ring.

Figure 8:
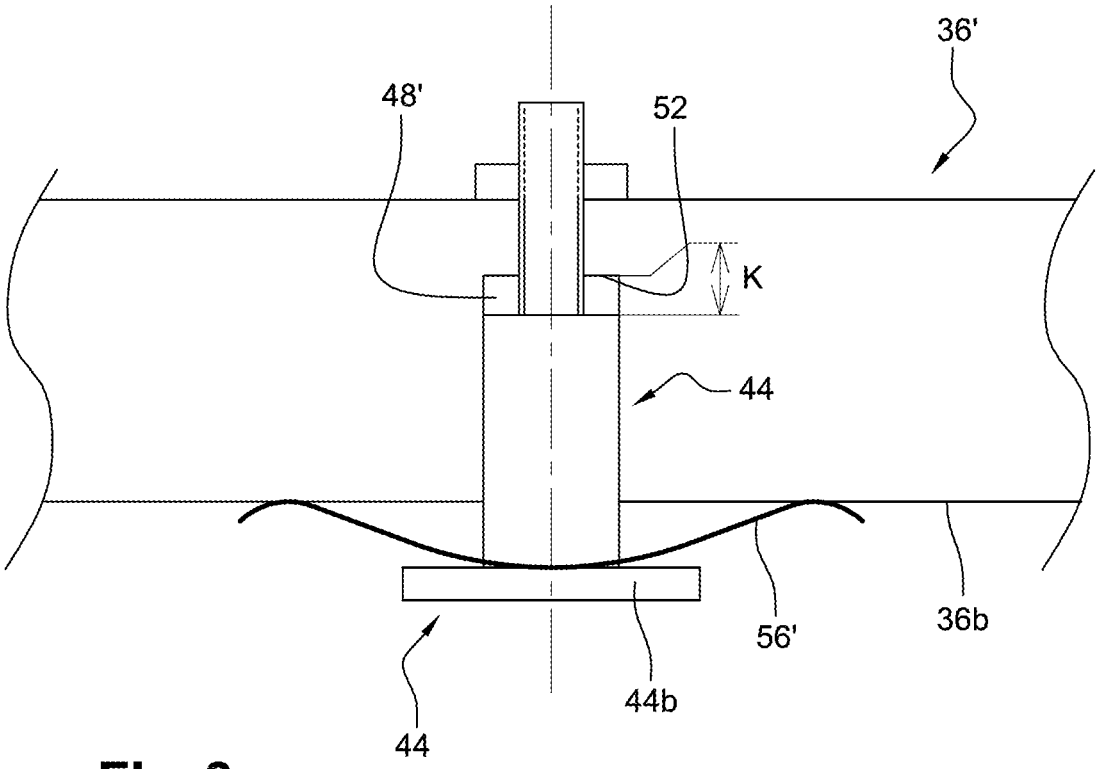
FIG. 8 shows an alternative embodiment of an assembly according to the disclosure.

FIG. 8 shows an alternative embodiment of the disclosure wherein the same numbers are used to refer to the elements already described above. The ring 36' is different from that described above, in particular in that the elastically deformable means 56' are here formed by a leaf spring. The leaf spring can be elongated and have a general shape of an inverted Ω, the longitudinal ends of which bear against the internal peripheral surface 36*b* of the body of the ring and the middle part of which bears against the portion 44*b* of the skid 44. In an alternative version, the leaf spring could have an annular shape and a section with a general shape of an inverted Ω, the outer periphery of which would bear against the internal peripheral surface 36*b* of the body of the ring and the center of which would bear against the portion 44*b* of the skid 44. In this embodiment, the housing 48' for the mounting of the skid only comprises one shoulder 52. The housing 48 is thereby simplified.

While illustrative embodiments have been illustrated and described, it will be appreciated that various changes can be made therein without departing from the spirit and scope of the disclosure.

The embodiments of the invention in which an exclusive property or privilege is claimed are defined as follows:

1. A control assembly for a stage of variable-pitch vanes for a turbine engine, each variable-pitch vane having a cylindrical pivot at a radially outer end thereof, the control assembly comprising:

an actuating ring having an annular body having an axis of revolution;

a vane guidance means for connecting to the cylindrical pivots of the variable pitch vanes;

a rotating means for rotating the actuating ring about a casing of the turbine engine; and a centering means for cooperating with the casing to center the actuating ring, the centering means having at least one skid bearing against the casing, the skid being secured to a rod that intersects with a radial housing of the actuating ring, and the skid having an abutment element bearing against a radially external surface of the actuating ring, wherein at least one of the skid or the rod are configured to cooperate by radial sliding with an inner wall of a housing, and in that an elastically deformable bearing means are mounted between the skid and the actuating ring to urge the skid radially towards the casing, the skid being configured to be mobile during operation by sliding between a radially internal position defined by a bearing against the abutment element on the actuating ring, and a radially external position wherein the abutment element is at a distance from the actuating ring, wherein the skid and the rod are monolithic, wherein the skid comprises a first cylindrical portion with a first diameter that is smaller than a second cylindrical portion, the first cylindrical portion extending between the rod and the second cylindrical portion, the second cylindrical portion being configured to bear against the casing, wherein the first cylindrical portion is inserted by sliding in an intermediate cylindrical part of the housing which extends radially between a first cylindrical part with a second diameter that is smaller than a third diameter of the intermediate cylindrical part and a second cylindrical part which opens onto the actuation ring, wherein a first annular shoulder connects the first cylindrical part and the intermediate cylindrical part and wherein a second annular shoulder connects the second cylindrical part and the intermediate cylindrical part, and wherein the elastically deformable bearing means bear against the second annular shoulder and the first cylindrical portion is able to bear against the first annular shoulder.

2. The control assembly according to claim 1, wherein the rod comprises a cylindrical section and a threaded section, the cylindrical section being configured to cooperate by sliding with an internal cylindrical surface of the housing, and the abutment element being a nut that cooperates with the threaded section of the rod.

3. The control assembly according to claim 1, wherein the elastically deformable bearing means are annular and extend around the skid.

4. The control assembly according to claim 1, wherein the elastically deformable bearing means bear against an internal peripheral surface of the actuating ring.

5. A stage of variable-pitch vanes for a turbine engine, the stage comprising an annular row of variable-pitch vanes, each variable-pitch vane having a blade and a cylindrical pivot at a radially external end thereof, the stage further having an annular casing with a plurality of orifices, each orifice for mounting the cylindrical pivot of one variable-pitch vane, wherein each cylindrical pivot is connected to a control assembly according to claim 1.

6. An aircraft turbine engine comprising a control assembly according to claim 1.

7. The control assembly according to claim 1, wherein the skid and the rod are connected by a rigid connection.

8. The control assembly according to claim 1, wherein the rod is free to move relative to the abutment element.

9. A control assembly for a stage of variable-pitch vanes for a turbine engine, each variable-pitch vane having a cylindrical pivot at a radially outer end thereof, the control assembly comprising:

an actuating ring having an annular body having an axis of revolution;

a guide configured to connect to the cylindrical pivots of the variable pitch vanes;

an actuator configured to rotate the actuating ring about a casing of the turbine engine; and a centering assembly configured to cooperate with the casing to center the actuating ring, the centering assembly having a skid bearing against the casing, the skid being secured to a rod that intersects with a radial housing of the actuating ring, and the skid having an abutment element bearing against a radially external surface of the actuating ring, wherein at least one of the skid or the rod are configured to cooperate by radial sliding with an inner wall of a housing, and in that an elastically deformable bearing is mounted between the skid and the actuating ring to urge the skid radially towards the casing, the skid being configured to be mobile during operation by sliding between a radially internal position defined by a second bearing against the abutment element on the actuating ring, and a radially external position wherein the abutment element is at a distance from the actuating ring, wherein the skid comprises a first cylindrical portion with a diameter that is smaller than a second cylindrical portion, the first cylindrical portion extending between the rod and the second cylindrical portion, the second cylindrical portion being configured to bear against the casing, wherein the first cylindrical portion is inserted by sliding in an intermediate cylindrical part of the housing which extends radially between a first cylindrical part with a smaller diameter than the diameter of the intermediate cylindrical part and a second cylindrical part which opens onto the actuation ring, and wherein a first annular shoulder connects the first cylindrical part and the intermediate cylindrical part and a second annular shoulder connects the second cylindrical part and the intermediate cylindrical part, and wherein the elastically deformable bearing means bear against the second annular shoulder and the first cylindrical portion being able to bear against the first annular shoulder.

* * * * *